US009784530B1

(12) United States Patent
Myers

(10) Patent No.: US 9,784,530 B1
(45) Date of Patent: Oct. 10, 2017

(54) GUN HOLSTER SYSTEM AND METHOD OF USE

(71) Applicant: James Myers, Abilene, TX (US)

(72) Inventor: James Myers, Abilene, TX (US)

( * ) Notice: Subject to any disclaimer, the term of this patent is extended or adjusted under 35 U.S.C. 154(b) by 0 days.

(21) Appl. No.: 15/370,465

(22) Filed: Dec. 6, 2016

Related U.S. Application Data

(60) Provisional application No. 62/414,292, filed on Oct. 28, 2016.

(51) Int. Cl.
*F41C 33/00* (2006.01)
*F41C 33/02* (2006.01)
*F41C 33/04* (2006.01)

(52) U.S. Cl.
CPC ..... *F41C 33/0236* (2013.01); *F41C 33/041* (2013.01); *F41C 33/0272* (2013.01)

(58) Field of Classification Search
CPC . F41C 33/0236; F41C 33/041; F41C 33/0272
USPC ..... 224/183, 192, 193, 196, 198
See application file for complete search history.

(56) References Cited

U.S. PATENT DOCUMENTS 3,003,670 A * 10/1961 Stella ..... F41C 33/0209 224/192
3,008,617 A * 11/1961 Villwock ..... F41C 33/0209 224/183
3,707,250 A * 12/1972 Esposito ..... F41C 33/0227 224/243
4,620,654 A * 11/1986 Cook ..... F41C 33/0227 224/192
5,018,653 A * 5/1991 Shoemaker ..... F41C 33/0227 224/193
5,251,798 A * 10/1993 Theodore ..... F41C 33/0227 224/192
5,322,200 A * 6/1994 Blanchard ..... F41A 17/02 224/192
5,632,426 A * 5/1997 Beletsky ..... A45F 5/021 224/192
5,820,003 A * 10/1998 Nichols ..... F41C 33/0227 224/192
6,604,657 B2 * 8/2003 Yirmiyahu ..... F41C 33/0227 224/243
2007/0163164 A1 * 7/2007 Avrahami ..... F41C 33/0227 42/87
2013/0221045 A1 * 8/2013 McStay ..... A45F 5/021 224/183

* cited by examiner

*Primary Examiner* — Adam Waggenspack
*Assistant Examiner* — Lester L Vanterpool
(74) *Attorney, Agent, or Firm* — Richard Eldredge; Eldredge Law Firm

(57) ABSTRACT

A gun holster system includes a body having a front side and a back side forming an upper opening disposed therebetween and forming a lower opening at a lower surface of the body; a strap assembly integrally secured to the body; a first magnet disposed within a thickness of the fastener protrusion; and a second magnet disposed within a thickness of the housing. The strap assembly includes an elongated strap extending from the body; a fastener protrusion extending from a surface of the elongated strap; and a faster housing extending from an outer surface of the back side of the body.

3 Claims, 4 Drawing Sheets

GUN HOLSTER SYSTEM AND METHOD OF USE

BACKGROUND

1. Field of the Invention

The present invention relates generally to gun holsters.

2. Description of Related Art

Gun holsters are well known in the art and are effective means to carry a firearm. For example, FIG. 1 is a front view of a conventional gun holster 101 having a body 103 forming an opening configured to receive a pistol 105 therein. A strap 107 is integrally attached to the body 103 at one end and removably engaged at a second end via a fastener 111, e.g., a button. The gun holster 101 is secured to an article of clothing such as a belt (not shown) of a user via a clip 109.

One of the common problems associated with holster 101 is the limited use and weight. For example, the bulkiness of holster 101 restricts the user's ability to effectively conceal the firearm and the weight deters some parties from carrying the firearm. Although great strides have been made in the area of gun holsters, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
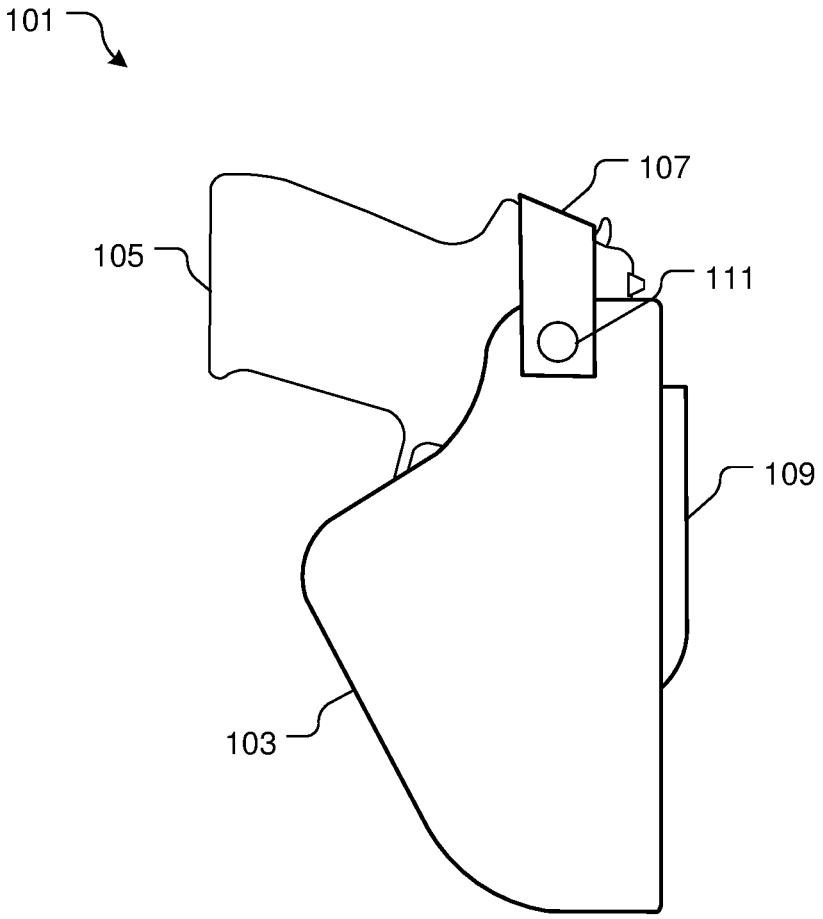
FIG. 1 (Prior Art)
FIG. 1 is a front view of a conventional gun holsters.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, the figures depict various views of a gun holster system 201 and method of use in accordance with a preferred embodiment of the present application. It will be appreciated that the gun holster system 201 overcomes one of more of the above-listed problems commonly associated with the conventional gun holsters.

Figure 2:
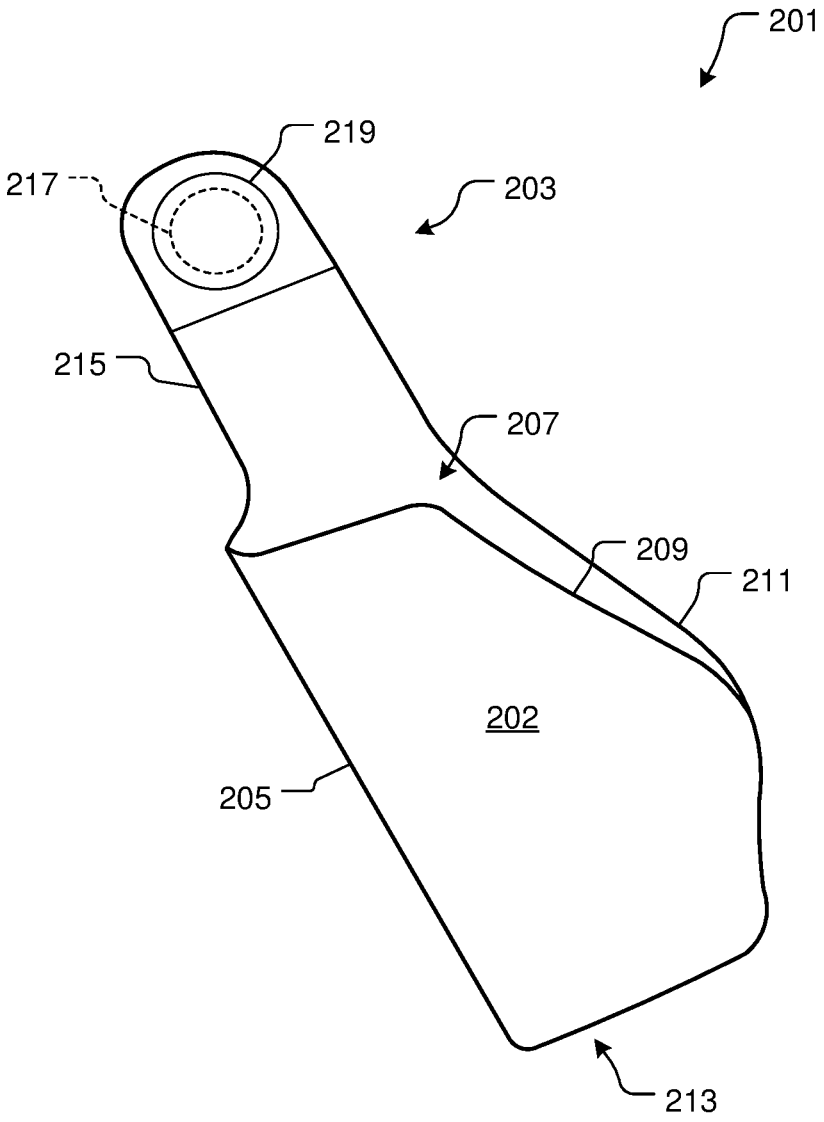
FIG. 2 is front oblique view of a gun holster system in accordance with a preferred embodiment of the present invention.
Figure 3:
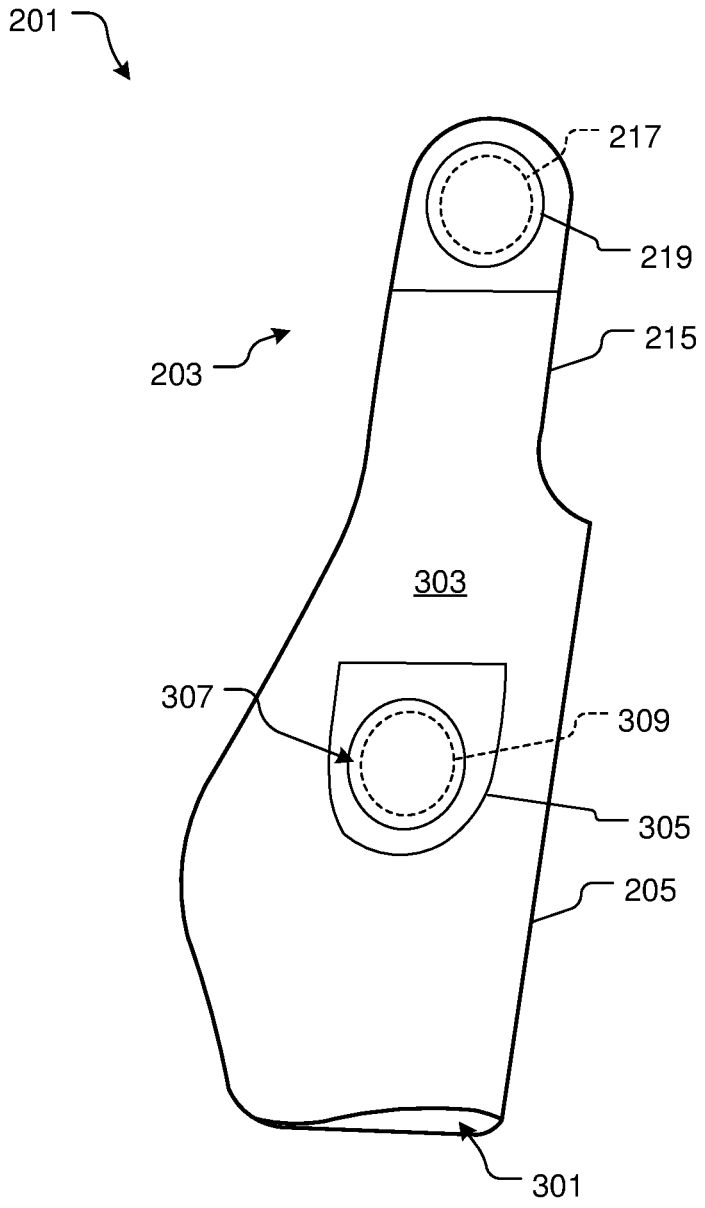
FIG. 3 is a back oblique view of the gun holster of FIG. 2.

In FIG. 2, a front oblique view of system 201 is shown having a strap assembly 203 integrally attached to a body 205. During use, the body 205 is configured to carry a firearm while assembly 203 is configured to secure the body and firearm to an article of clothing.

Body 205 forms an upper opening 207 with partially separated sides 209, 211. The upper opening 207 is designed to receive a firearm (not shown) therein while sides 209, 211 are configured to come in contact with the sides of the firearm and configured to secure the firearm in a removably fixed position. Body 205 further includes a lower opening 301 that extend through a bottom surface 213. The opening 301 is adapted to receive the barrel of the firearm therethrough.

Figure 4B:
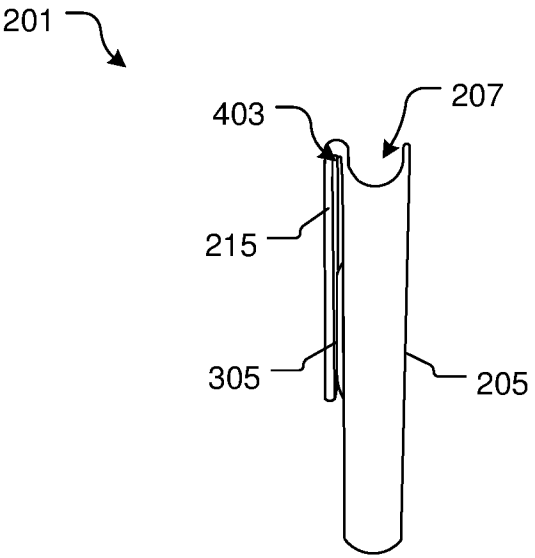
FIGS. 4A and 4B are side views of the gun holster of FIG. 2.
Figure 4A:
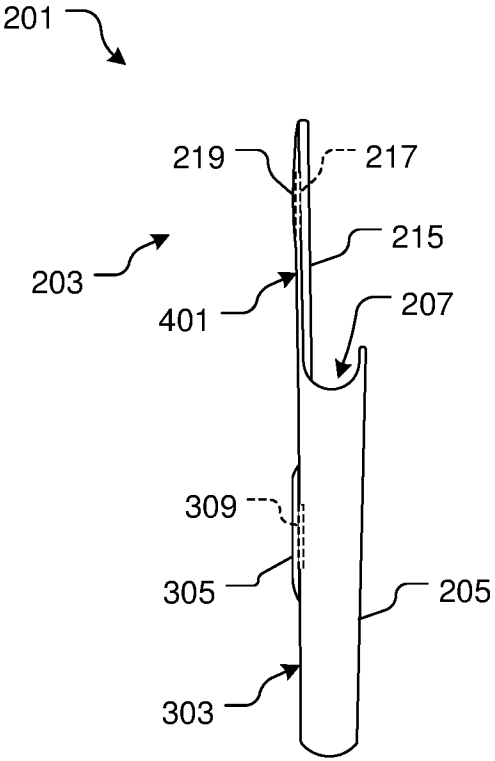

Assembly 203 includes an elongated strap 215 that has a fastener protrusion 219 that extends from surface 401, as depicted in FIG. 4A. The fastener protrusion is configured to engage within a cavity 307 created by a housing 305 the extends from surface 303. As depicted in FIGS. 4A and 4B, the protrusion fits within housing, which in turn creates a means to secure the assembly to the body. Accordingly, the protrusion and the cavity have the same geometric cylindrical shape.

The system 201 is further provided with 2 magnets 217 disposed within the thickness of the protrusion 219 and a third magnet disposed within the thickness of housing 305. The two magnets provide additional means to secure the strap 215 to the body 205. The magnet in 217 and 307 when connected cause retention on the gun so the gun will not fall out.

As shown in FIGS. 4A and 4B, the strap 215 is configured to fold about a joint 403 that enables connection between protrusion 219 and housing 305. The area between strap 215 and surface 303 of body 205 is adapted to receive an article of clothing there between and magnet retention on the gun.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A gun holster system for carrying a gun, comprising:

a body having a front side and a back side forming an upper opening disposed therebetween and forming a lower opening at a lower surface of the body;

a strap assembly integrally secured to the back side body, the strap assembly having:

an elongated strap extending from and integrally secure to the back side of the body;

a fastener protrusion extending from a back surface of the elongated strap; and a fastener housing extending from an outer surface of the back side of the body, the fastener housing being configured to engage with the fastener protrusion;

wherein the elongated strap folds backwards and away from the upper opening to cause the fastener protrusion and the fastener housing to engage;

two magnets disposed within a thickness of the fastener protrusion; and a third magnet disposed within a thickness of the housing;

wherein the two magnets are configured to engage with the third magnet;

wherein engaging the two magnets with the third magnet does not obstruct the upper opening and does not obstruct or hinder entire removal of the gun from the body; and wherein a combined magnetic retention strength generated by the two magnets and third magnet is strong enough to retain the gun within the body.

2. The system of claim 1, further comprising:

a cavity formed by the housing;

wherein the protrusion removably secured within the cavity.

3. The system of claim 1, wherein the lower opening is configured to receive a portion of the gun therethrough.

* * * * *